US005286032A

United States Patent [19]

Spencer

[11] Patent Number: 5,286,032

[45] Date of Patent: Feb. 15, 1994

[54] STEER WRESTLING DUMMY

[76] Inventor: Everett E. Spencer, Rte. 1, Box 312-1, Drumright, Okla. 74030

[21] Appl. No.: 65,834

[22] Filed: May 21, 1993

[51] Int. Cl.[5] ..... A63B 69/00

[52] U.S. Cl. ..... 273/339

[58] Field of Search ..... 273/336, 337, 338, 339

[56] References Cited

U.S. PATENT DOCUMENTS

| | | | |
|---|---|---|---|
| 3,711,098 | 1/1973 | McCord | 273/336 |
| 3,776,553 | 12/1973 | Kelton | 273/339 |
| 3,802,706 | 4/1974 | Hamm | 273/339 |
| 3,947,033 | 3/1976 | Bennett | 273/339 |
| 4,136,874 | 1/1979 | McCord | 273/339 |
| 4,286,788 | 9/1981 | Simington et al. | 273/359 |
| 4,364,570 | 12/1982 | Hallam | 273/338 |
| 4,498,676 | 2/1985 | Runner | 273/336 |
| 4,640,515 | 2/1987 | Rhine | 273/339 |
| 4,662,642 | 5/1987 | Archibald | 273/339 |
| 4,981,302 | 1/1991 | Narramore | 273/339 |
| 4,995,618 | 2/1991 | Panzner | 273/367 |
| 5,009,432 | 10/1990 | Richard | 273/339 |
| 5,080,373 | 1/1992 | Jones | 273/338 |

*Primary Examiner*—William H. Grieb

*Attorney, Agent, or Firm*—Catalano, Zingerman & McKay

[57] ABSTRACT

A steer wrestling dummy towable by a motorized vehicle includes a body, a lower neck hinged to turn laterally on the body, an upper neck hinged to turn laterally on the lower neck in the same direction as the lower neck turns on the body and a head hinged to rotate upwardly on the upper neck. The body is mounted in an upright position on top of a support and the bottom of the support is mounted on a frame with at least two spaced apart tires for transporting the support with the body positioned laterally of and above the frame and aligned for forward movement therewith.

The head, the upper and lower necks, the body and the support are biased to resist the proper training, testing and rotating motions characteristic of a steer responding to the steer wrestling technique of a cowboy.

The biasing forces of all coil spring and stability components are easily changed by adjustment of the length of chain, cable or linkage connected to the biasing component so that the steer's operation can be made suitable for training of cowboys of any size, strength or skill level.

28 Claims, 17 Drawing Sheets

Fig. 18
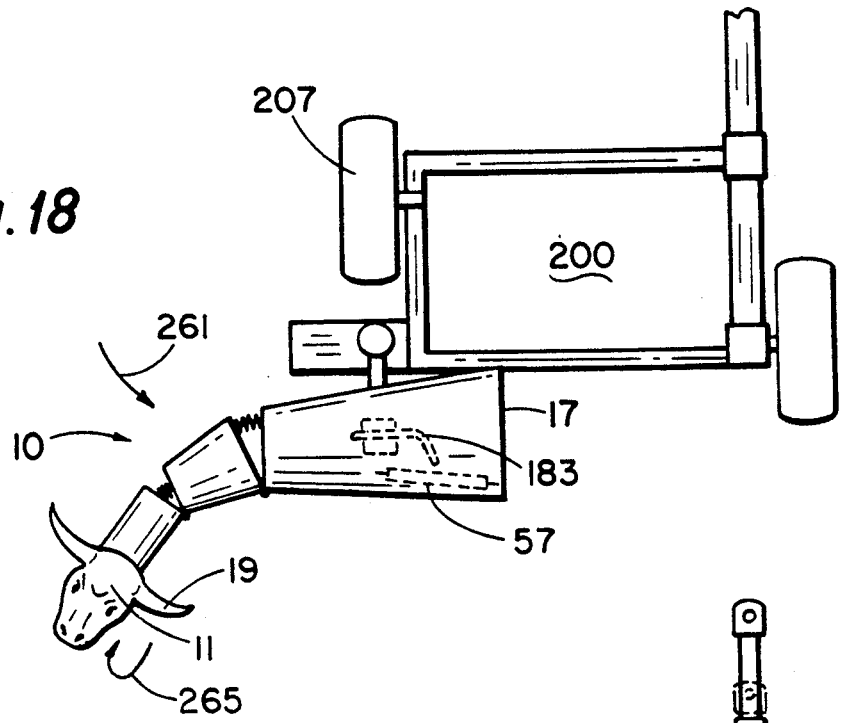
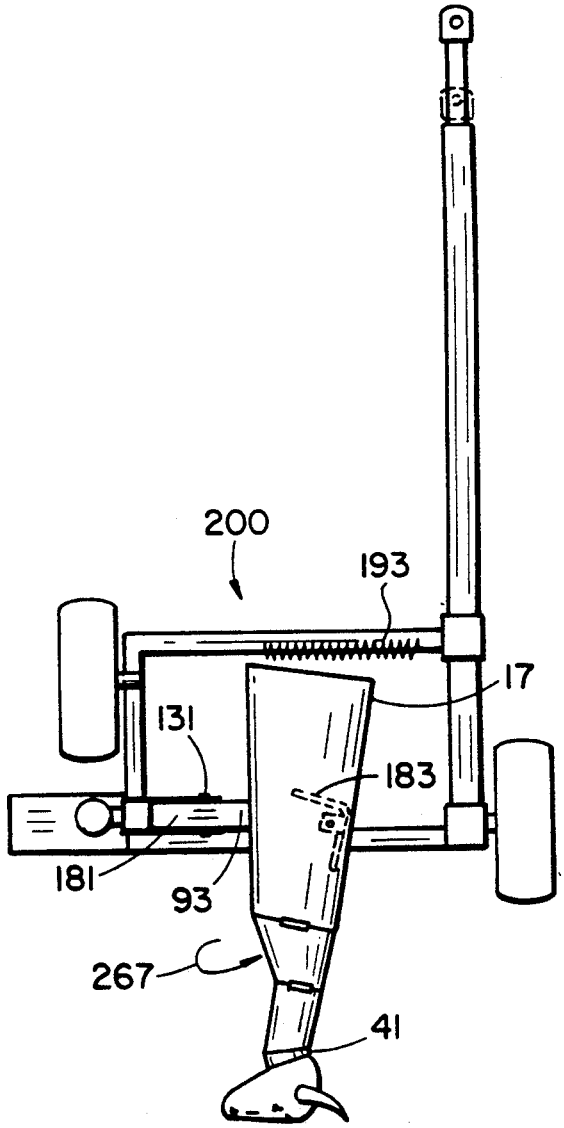
Fig. 19

STEER WRESTLING DUMMY

BACKGROUND OF THE INVENTION

This invention relates generally to athletic equipment and more particularly concerns a steer wrestling dummy for training beginning, amateur and professional rodeo cowboys.

Steer wrestling expertise includes, among other aspects, catching, slowing down and throwing a steer with the least amount of effort and in the quickest time possible.

In catching a steer, the cowboy must adjust his body position as he dismounts his horse in relation to the position of the steer's horns so that he will not miss the steer. While every steer wrestler hopes and trains for a normal catch, he must also train for unusual conditions. Some steers are easy and others tricky. The level of any given steer's head may be naturally low or high. The tendency of the steer may be to lower either the left or right horn. If the inside horn drops, the cowboy must further lower his body during his dismount. If the outside horn drops, the cowboy must adjust his dismount somewhat higher to bring his body over the top of the steer and insure that his right arm will go further down under the right horn.

Once the catching process is complete, the cowboy must slow down or stop the steer. In accomplishing this, during his dismount the cowboy's right arm must go under the steer's right horn while his left hand grabs the left horn as far to the left as possible to create better leverage for positioning the steer's head. When the cowboy's feet come in contact with the ground, he holds the steer's head close to his body, 'crosses' the steer by pushing down on the left horn and lifting up on the right horn and 'curls' the steer by pulling the steer's head around the cowboy to put the steer in an unbalanced position and enable the cowboy to slow the steer down.

When the cowboy feels he has slowed the steer sufficiently, he will attempt to throw the steer to the ground. To accomplish this, he shifts his hip into the steer's shoulder and pulls the steer's head and neck around the cowboy's body, pulling the steer's body further off balance. When the steer's body gets to approximately 100° to 130° in relation to its original path, the cowboy reaches over the left horn with his left arm, puts his arm under the steer's jaw pulls the steer's head up and straightens from a crouch to a stand to lift the steer's front feet off the ground. At approximately 150° to 180° the cowboy will thrust himself backwards and the steer will be rolled on its side and the throwing portion of the steer wrestling process is completed.

In perfecting these techniques, training generally involves live horses and steers so as to expose the cowboy to the wide variety of conditions he might encounter in the rodeo arena. However, training with live horses and steers has some major disadvantages. When the cowboy dismounts, the horse is free to roam. And, when the cowboy releases the thrown steer, the steer is also free to roam. As a result, a considerable amount of the cowboy's practice time is expended in round-up rather than wrestling. Also, live horses and steers are unpredictable, making it difficult for the cowboy to repeatedly practice any selected aspect of his technique in relation to selected steer sizes and tendencies. As a result, the cowboy may not be able to recreate specific conditions he wishes to train for. Furthermore, the unpredictability of the horse and steer movements increases the possibility of injury to the cowboy during the training session. The desirability of predictability is of course greater in proportion to the inexperience of the cowboy.

It is therefore an object of this invention to provide a steer wrestling dummy which simulates the movements of a steer in response to the movements of a cowboy during the steer wrestling process. Another object of this invention is to provide a steer wrestling dummy that is adjustable to simulate steers of various sizes. Yet another object of this invention is to provide a steer wrestling dummy which can be adjusted to simulate steers of varying strength. It is also an object of this invention to provide a steer wrestling dummy which responds in life-like manner to the application of proper steer wrestling techniques. In addition, it is an object of this invention to provide a steer wrestling dummy whose size and/or weight simulation characteristics can be easily and quickly adjusted to accommodate the size, strength and ability of the cowboy. Another object of this invention is to provide a steer wrestling dummy readily repeatedly reusable in a short span of time.

SUMMARY OF THE INVENTION

In accordance with the invention, a steer wrestling dummy towable by a motorized vehicle is provided consisting of a body, a lower neck hinged to turn laterally on the body, an upper neck hinged to turn laterally on the lower neck in the same direction as the lower neck turns on the body and a head hinged to rotate upwardly on the upper neck. The body is mounted in an upright position on top of a support and the bottom of the support is mounted on a frame with at least two spaced apart tires for transporting the support with the body positioned laterally of an above the frame and aligned for forward movement therewith.

A coil spring connected between the upper and lower necks biases the upper neck against lateral turning and another coil spring connected between the lower neck and the body biases the lower neck against lateral turning. A coil spring connected between the head and the body biases the head against upward rotation.

The upper neck consists of two segments connected end-to-end on a longitudinal axis. The segment to which the head is hinged rotates about the axis in relation to the other segment and a coil spring connecting the segments biases the first segment against axial rotation. A flexible boot snugly encases the upper neck and coil spring.

The body is pivotally connected to the support to bob the head about a horizontal axis transverse to the forward alignment of the body. A shock absorber and/or coil spring connected between the body and the support biases the body against downward rotation of the head.

The support includes a main upright which is connected to the body and a secondary upright which is journalled on the frame for rotation about a vertical axis. The uprights are connected by an arm therebetween. A coil spring connected between the support and the frame biases the support against rotation about the vertical axis in a direction outwardly and rearwardly of the frame. A pin eccentric of the vertical axis reciprocally engages and disengages the support to and from the frame to lock the support against and release the support for rotation about the axis. A cable connected between the lower neck and the pin operates the pin in response to rotation of the lower neck to release the support to rotate about the vertical axis when the lower neck rotates to a preselected angle relative to the body. The pin is biased toward locking engagement with the frame.

The support also has an upper segment pivotally connected to a lower segment for articulation laterally relative to the body and toward the vertical axis so that the body of the steer can be rolled on its side. A coil spring connected between the upper segment and the frame biases the upper segment against lateral articulation and a reciprocal rod connected between the upper and lower segments locks and releases the upper segment against and for articulation. The rod is operated by a cable connected to the head to release the upper segment for articulation when the head is upwardly rotated relative to the upper neck to a selected angle.

The tire closest to the support is mounted on an axle journalled on the frame to permit adjustment of its steering alignment relative to the other tire. A linkage connected between the secondary upright and the axle adjusts the alignment of the tire in response to rotation of the secondary upright. The linkage includes a cam for initiating and terminating adjustment of the tire alignment between selected angles of rotation of the secondary upright.

A telescoping tongue extends forwardly of the frame for connection to the motorized vehicle. A reciprocal pin locks and releases the telescoping tongue against and for extension. When the secondary upright has rotated to a selected angle, a cable connecting the pin to the secondary upright releases the tongue and thus slows the trailer in relation to the motorized vehicle.

The biasing forces of all coil spring and stability components are easily changed by adjustment of the length of chain or cable linkage connected to the biasing components so that the steer's operation can be made suitable for training of cowboys of any size, strength or skill level.

BRIEF DESCRIPTION OF THE DRAWINGS

Other objects and advantages of the invention will become apparent upon reading the following detailed description and upon reference to the drawings in which:

FIG. 18 is a top plan view of the steer wrestling dummy of FIG. 1 in a fourth steer wrestling position;

FIG. 19 is a top plan view of the steer wrestling dummy of FIG. 1 in a fifth steer wrestling position;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
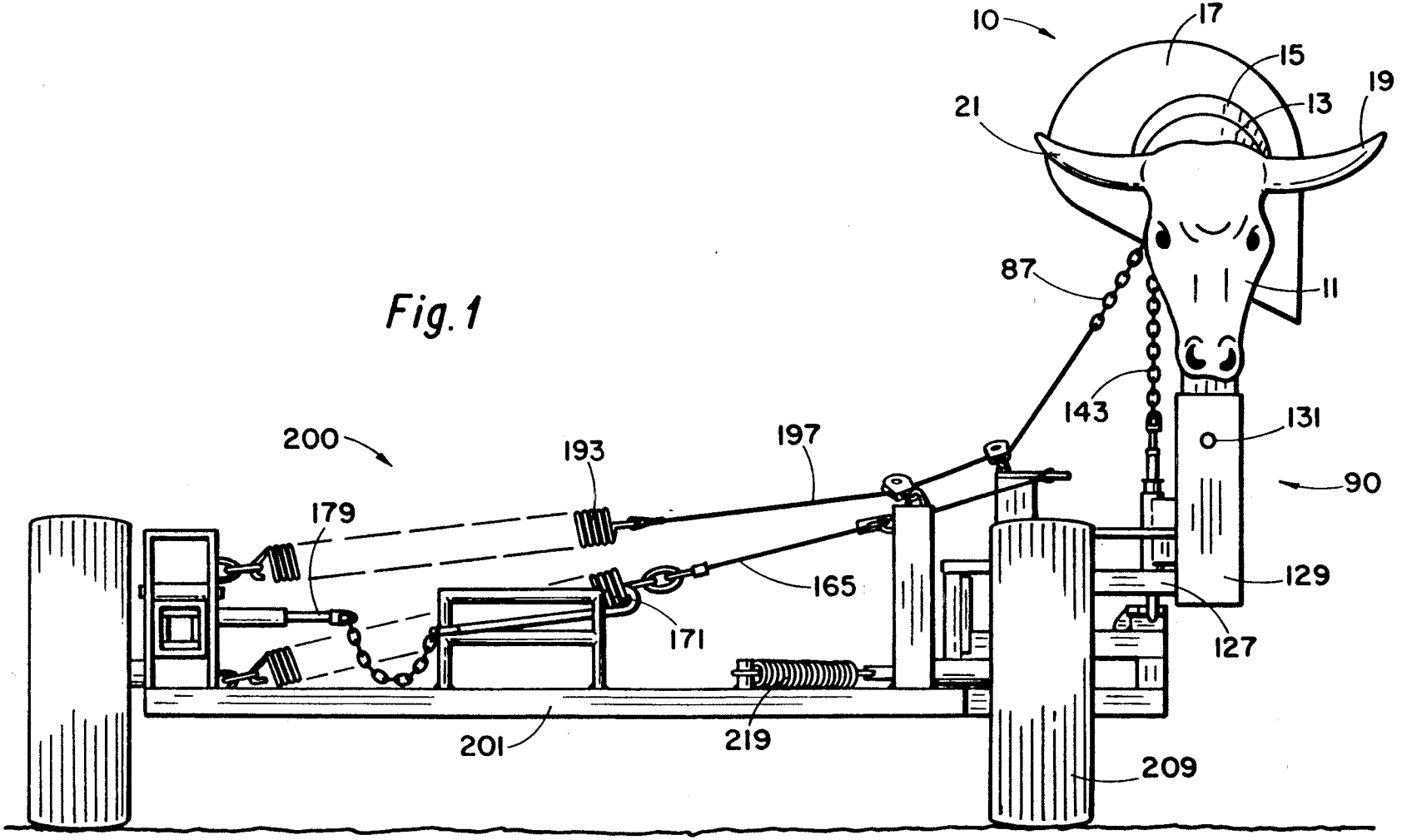
FIG. 1 is a front elevation view of a preferred embodiment of the steer wrestling dummy.
Figure 2:
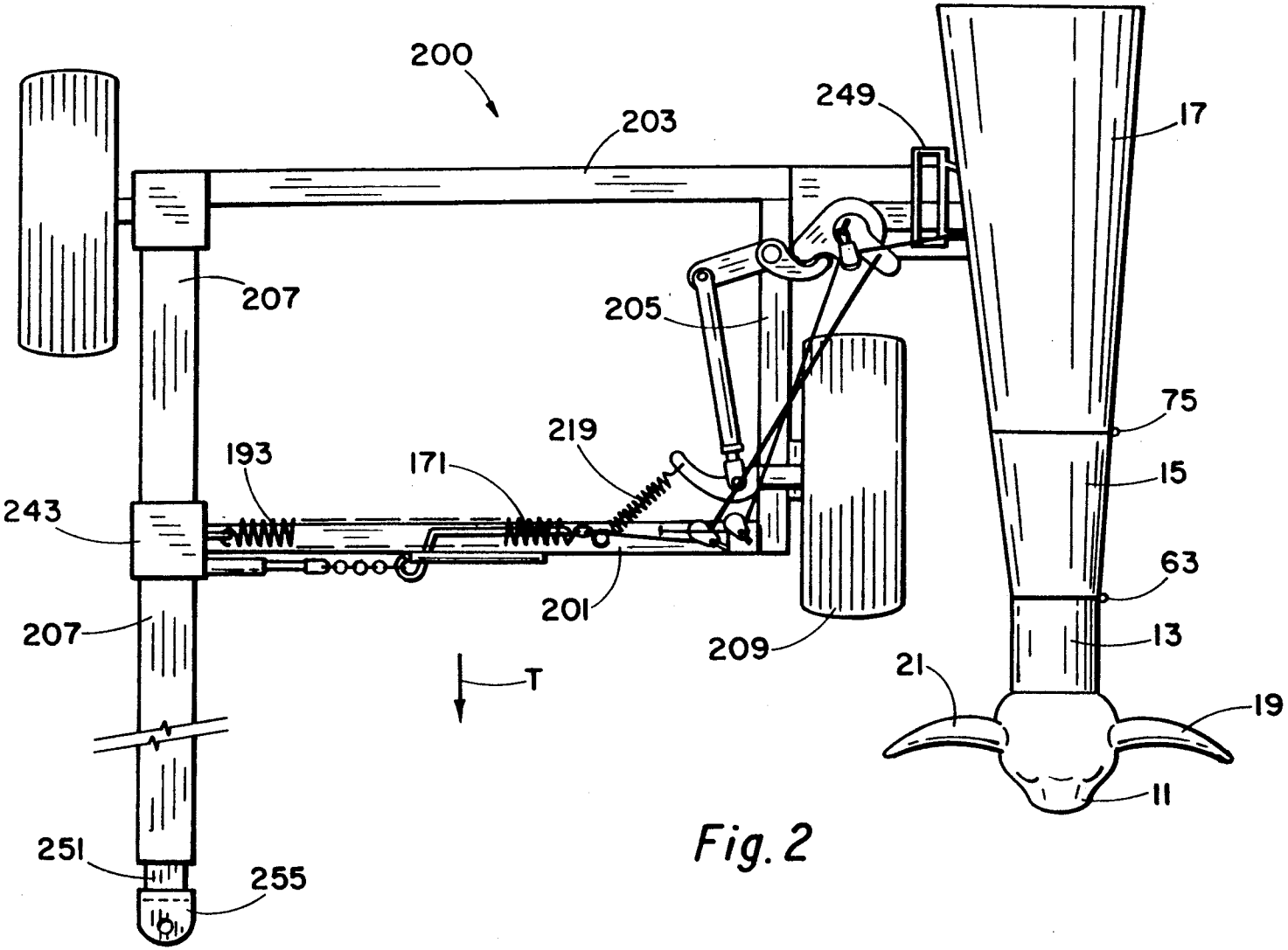
FIG. 2 is a top plan view of the steer wrestling dummy of FIG. 1.
Figure 3:
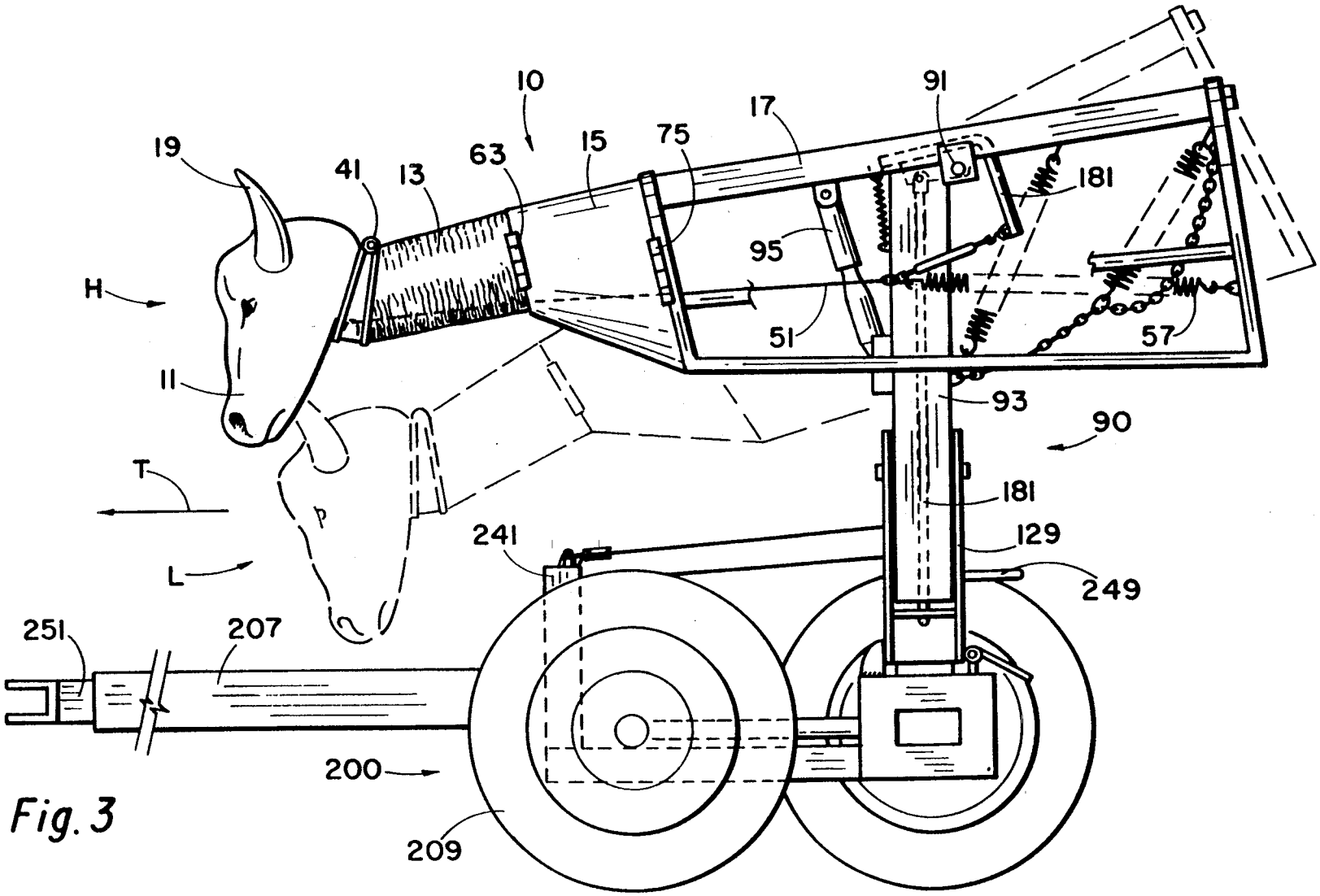
FIG. 3 is a left side elevation view of the steer wrestling dummy of FIG. 1.

Turning first to FIGS. 1 through 3, a preferred embodiment of the steer wrestling dummy is illustrated consisting of a steer assembly 10, a support assembly 90 and a trailer assembly 200. The steer assembly 10 includes the head 11, the upper neck 13, the lower neck 15 and the body 17. The steer's head 11 includes a pair of horns designated as the left or inside horn 19 and the right or outside horn 21, as considered in reference to a cowboy who will dismount his horse to catch the steer as the horse and steer are moving in side-by-side relationship in the same direction T.

Figure 4:
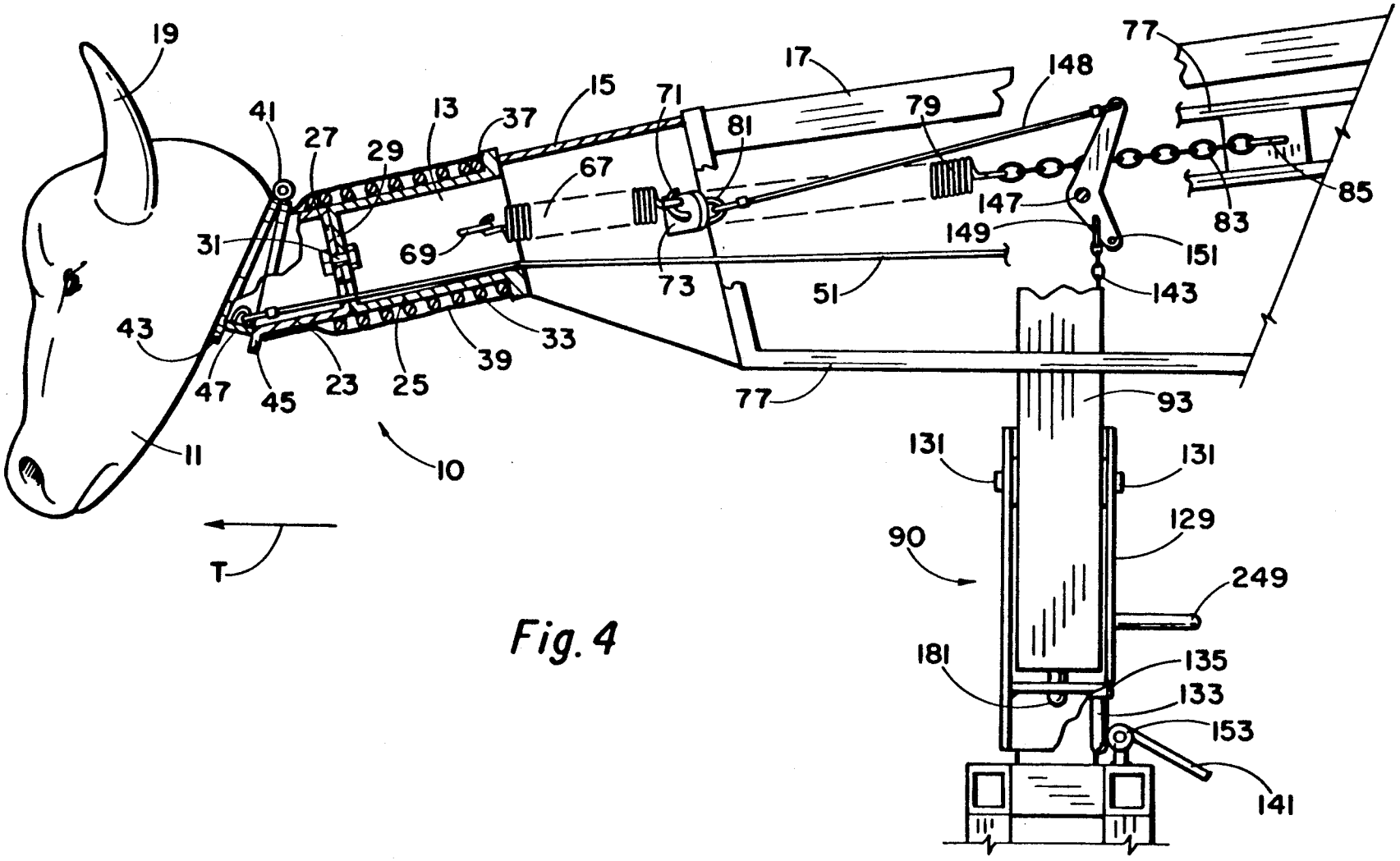
FIG. 4 is a right side elevation view with portions removed showing the details of the neck assembly of the steer wrestling dummy of FIG. 1.
Figure 5:
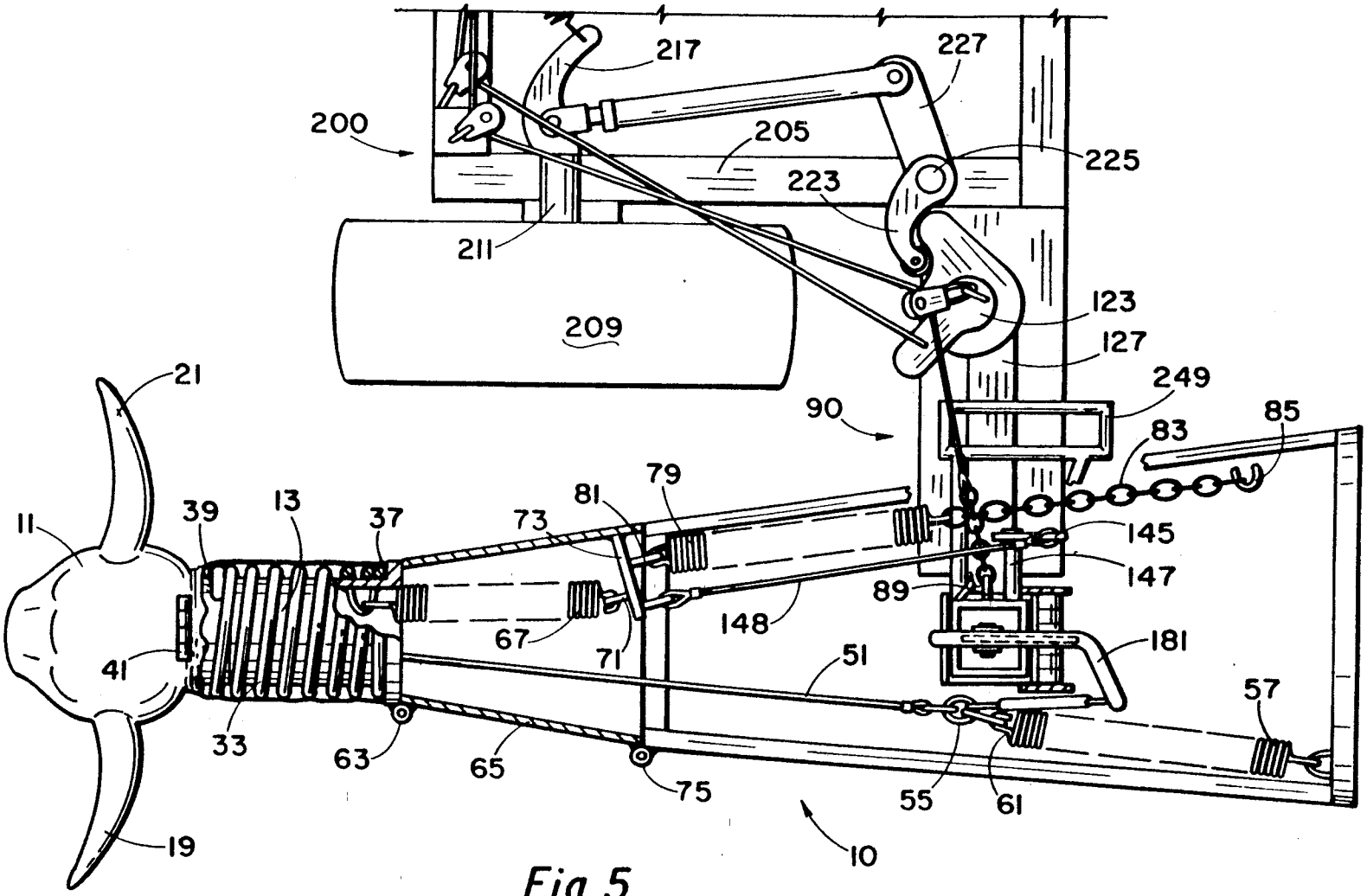
FIG. 5 is a top plan view with portions removed showing details of the neck assembly of the steer wrestling dummy of FIG. 1.

As can best be seen in FIGS. 4 and 5, the upper neck 13 of the steer consists of a first cylindrical member 23 aligned end-to-end with a second cylindrical member 25. A rear end plate 27 on the first cylindrical member 23 is mounted face-to-face with a front end plate 29 on the second cylindrical member 25. The two plates 27 and 29 are connected for rotation relative to each other by a bolt 31 extending through both plates 27 and 29. A coil spring 33, preferably a right hand wind spring approximately 4½ to 4¾ inches inner diameter, is welded at one end 35 to the first cylindrical member 23 and at the other end 37 to the second cylindrical member 25. Thus, the first cylindrical member 23 can be rotated against the bias of the coil spring 33 in relation to the second cylindrical member 25 by application of a rotating force to the first cylindrical member 23. When the force is removed, the first cylindrical member 23 will return to its normal condition in relation to the second cylindrical member 25. The upper neck 13 is covered by substantially cylindrical, flexibly resilient elastic member such as a rubber boot 39 which somewhat snugly encases the coil spring 33 and the cylindrical members 23 and 25. The head 11 of the steer, which may be molded of suitable plastic or fiberglass, for example, is connected to the upper neck 13 by a substantially horizontal hinge 41 having a first plate 43 connected to the head 11 and a second plate 45 welded to the front end of the first cylindrical member 23 in the upper neck 13. A bottom plate 47 welded at an angle to the first plate 43 on the head 11 forms a portion of the throat of the steer and spaces the lower portion of the hinged plates 43 and 45 apart so as to tip the steer's head 11 slightly upwardly in relation to the upper neck 13. A U-clamp 49 is welded to the upper surface of the bottom plate 47 so as to be disposed in the lower part of the steer's throat. A cable 51 secured at one end to the U-clamp 49 extends rearwardly through a passage 53 through the end plates 27 and 29 inside the upper neck 13 and through the lower neck 15. The other end of the cable 51 is connected by a short chain 55 to a coil spring 57 which is in turn connected to another U-clamp 59 welded to the frame of the steer's body 17. The coil spring 57 biases the steer's head 11 toward its lowermost position on the upper neck 13 and the steer's head 11 can be rotated upwardly against the bias of the spring 57 about the hinge 41. The force necessary to raise the steer's head 11 is quickly adjusted by changing the link of the chain 55 to which a hook 61 on the front end of the coil spring 57 is connected.

Figure 6:
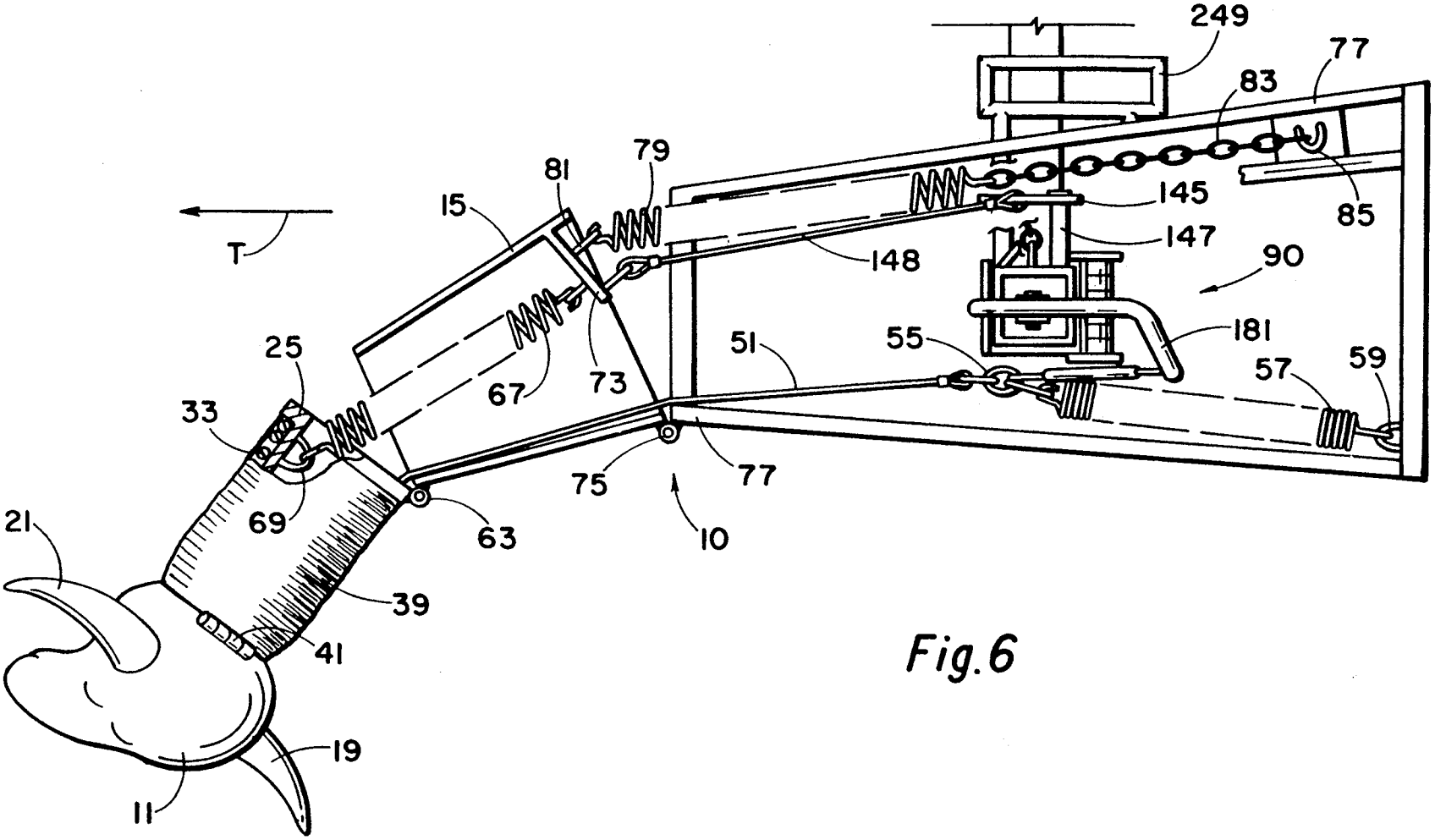
FIG. 6 is a top plan view with portions removed showing the details of the neck assembly of the steer wrestling dummy of FIG. 1 during the early stages of the steer wrestling process.

The upper neck 13 is connected to the lower neck 15 by a substantially vertical hinge 63 connected between the second cylindrical member 25 of the upper neck 13 and the wall 65 forming the lower neck 15. Another coil spring 67 is connected between a U-clamp 69 mounted on the interior right side of the steer's upper neck 13 and a U-clamp 71 welded to a plate 73 which is in turn welded to the inner right wall of the lower neck 15. Thus, a force exerted from right to left on the steer's head 11 which overcomes the bias of the spring 67 rotates the upper neck 13 about the hinge 63 in relation to the lower neck 15. The lower neck 15 is rotatively connected to the body 17 of the steer by a second substantially vertical hinge 75 between the left side of the wall of the lower neck 15 and the left side of the frame 77 of the body 17. Another coil spring 79 is connected between a U-clamp 81 welded to the back side of the plate 73 in the lower neck 15 and a chain 83. The chain 83 is also connected to another U-clamp 85 welded to the rear portion of the frame 77 of the body 17. Thus, the lower neck 15 is able to pivot about the second vertical hinge 75 against the bias of the coil spring 79 connected between the lower neck 15 and the body 17. As the force from right to left on the steer's head 11 is increased, the lower neck portion 15 turns to the left in relation to the body 17. The amount of force required to turn the lower neck portion 15 can be quickly adjusted by changing the length of the chain 83 connected to the coil spring 79. The rotated position of the head 11 and the turned positions of the upper neck 13 and lower neck 15 are illustrated in FIG. 6.

Figure 7:
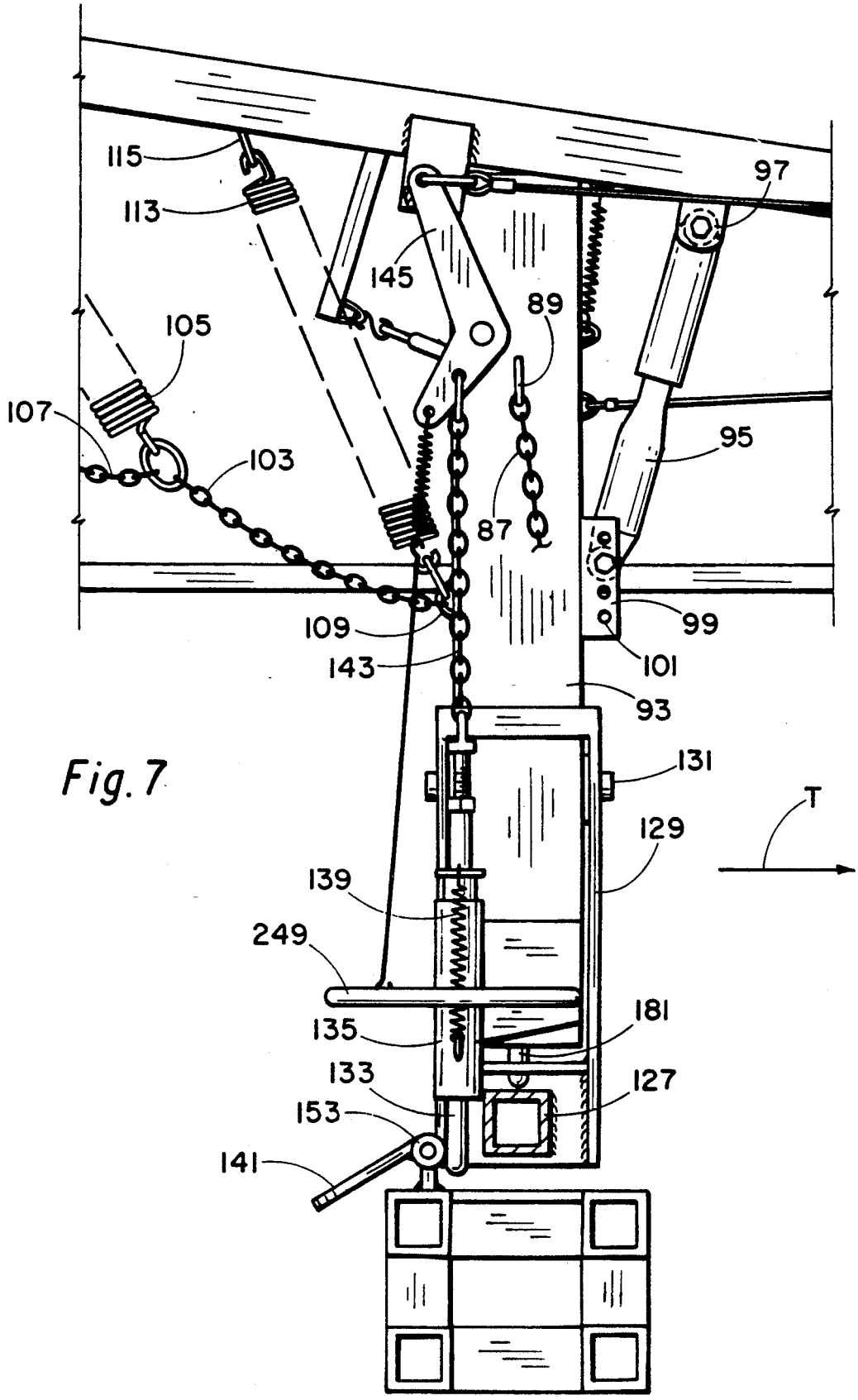
FIG. 7 is a right side elevation view with portions removed of the body support structure of the steer wrestling dummy of FIG. 1.
Figure 8:
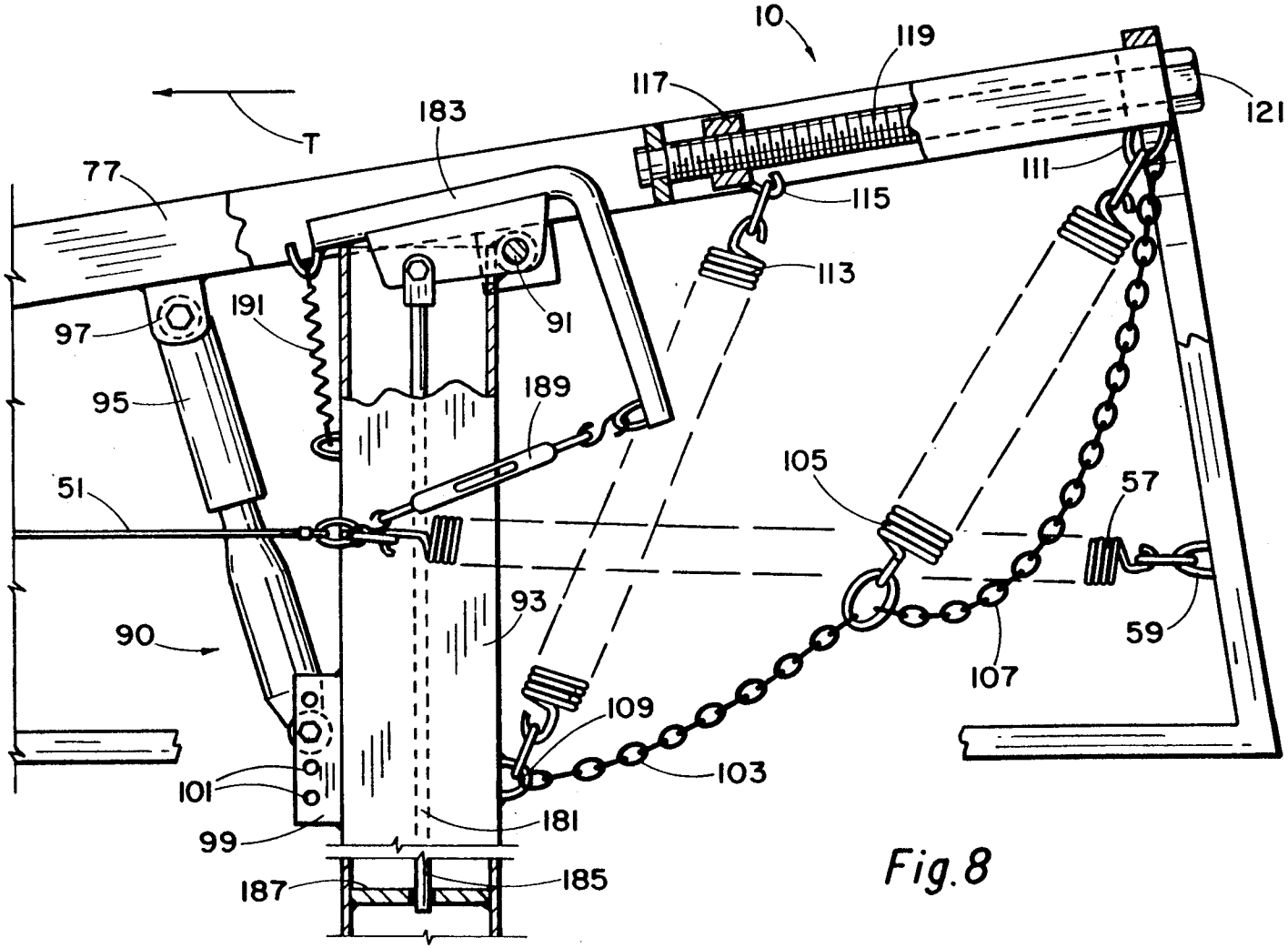
FIG. 8 is a left side elevation view with parts removed of the body support structure of the steer wrestling dummy of FIG. 1.
Figure 9:
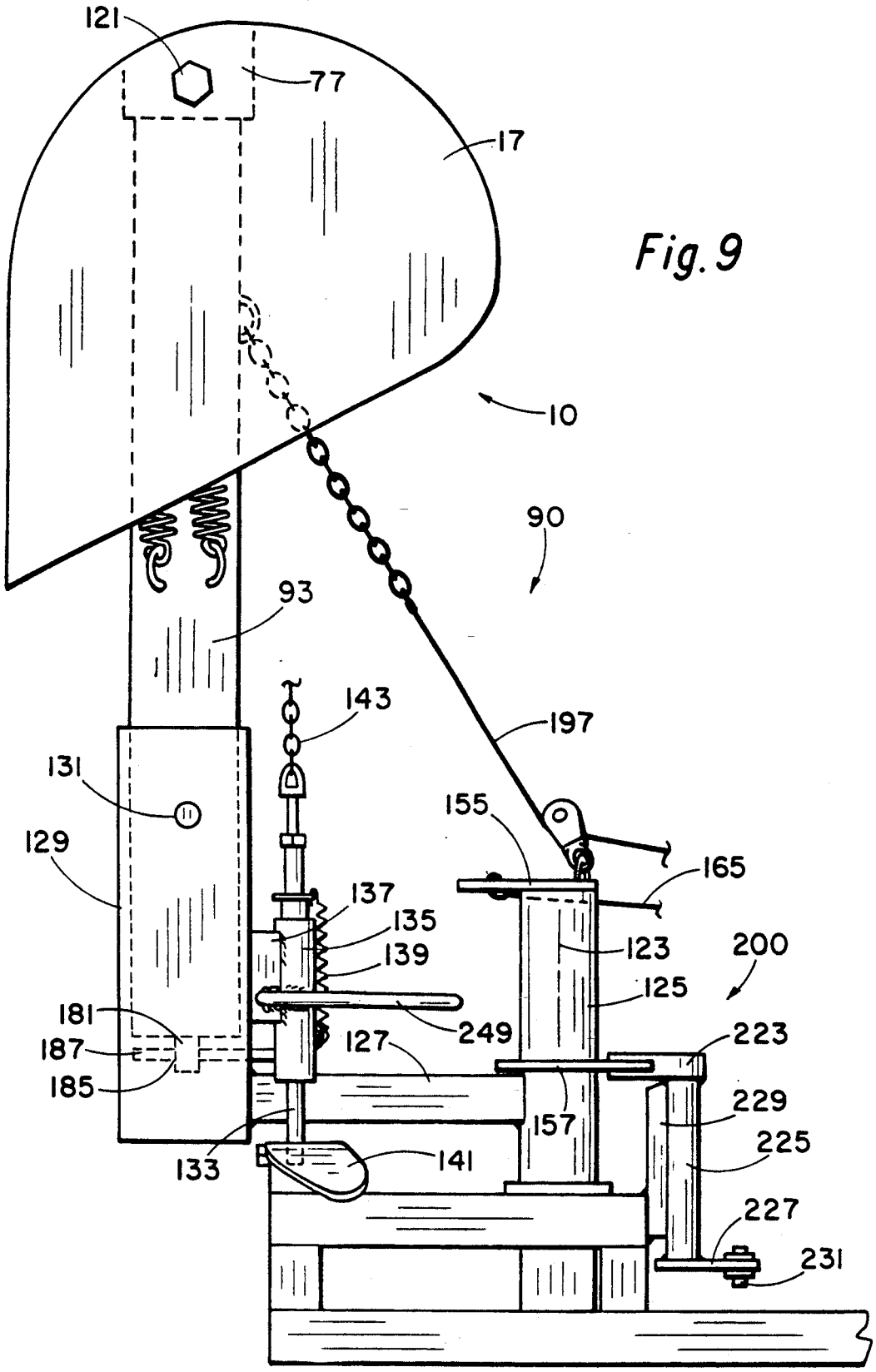
FIG. 9 is a rear elevation view with parts removed of the body support structure of the steer wrestling dummy of FIG. 1.
Figure 10:
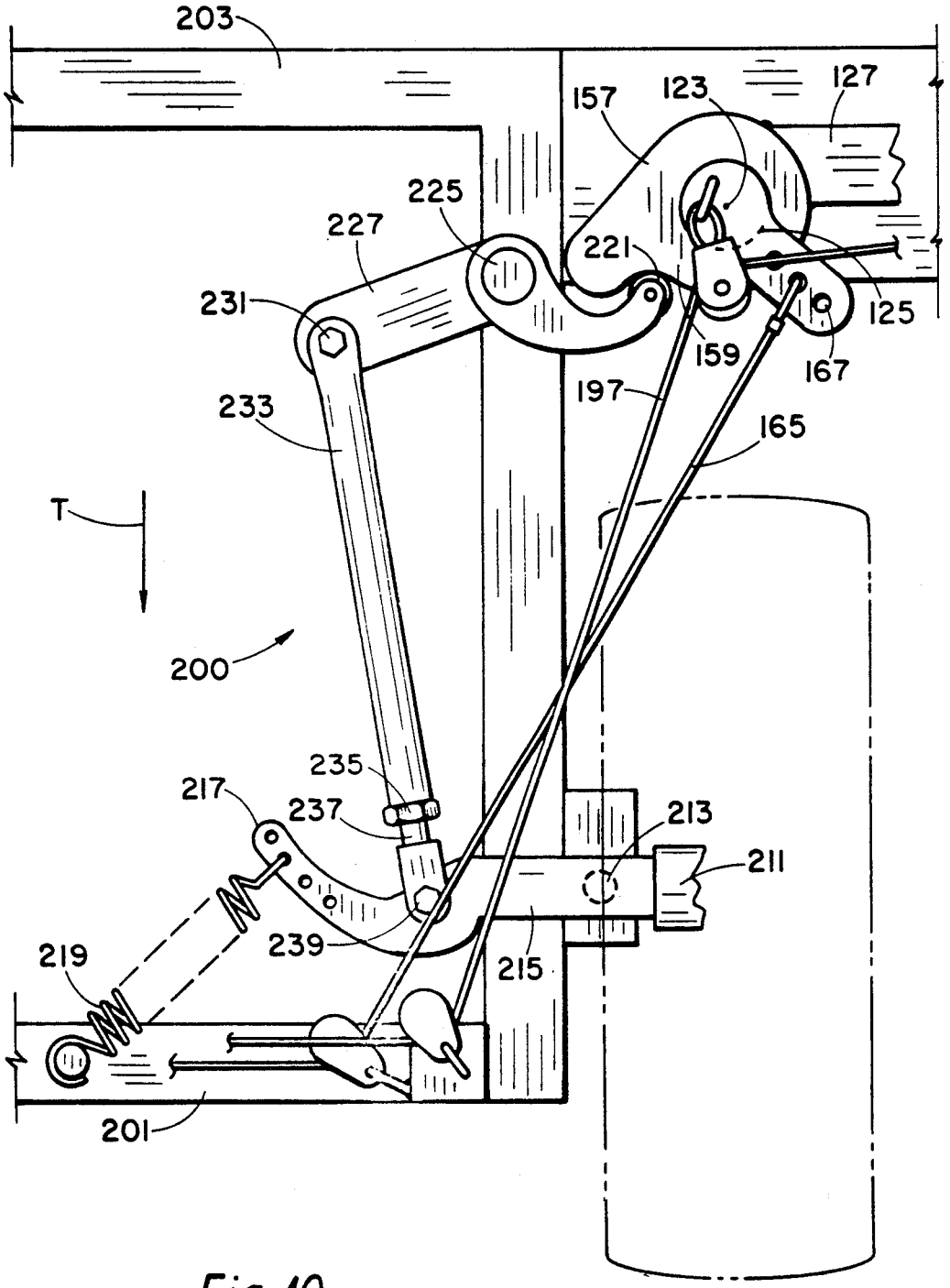
FIG. 10 is a top plan view with parts removed showing the trailer wheel assembly of the steer wrestling dummy of FIG. 1.
Figure 11:
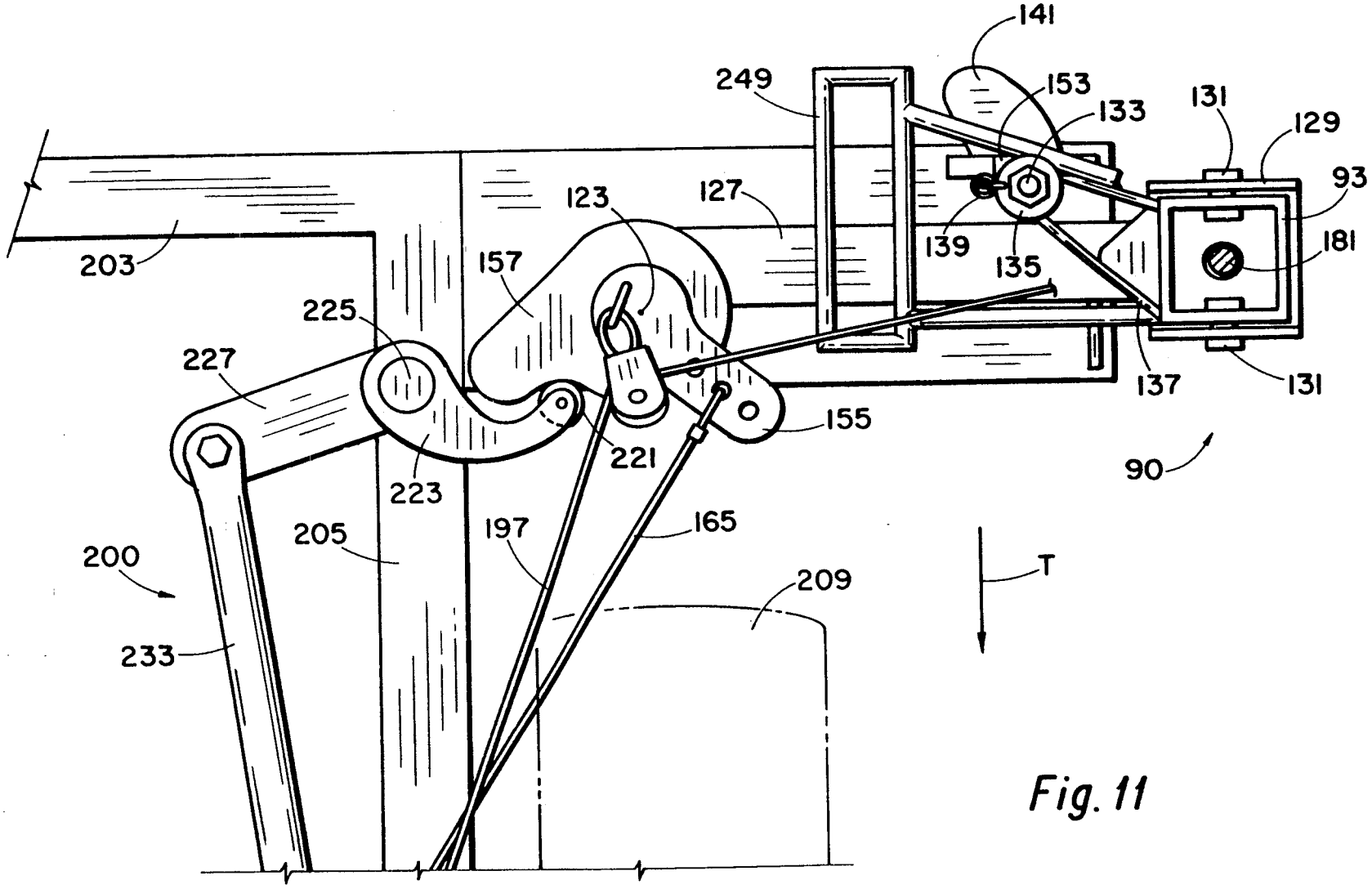
FIG. 11 is a top plan view of a portion of the trailer wheel assembly of FIG. 10 with the steer wrestling dummy of FIG. 1 in an initial position.

As can best be seen in FIGS. 7, 8 and 9, the steer assembly 10 is connected to a support assembly 90 by a horizontal pivot pin 91 transverse to the direction of travel T of the steer. The pivot pin 91 which rotatively mates brackets on the frame of the steer's body 17 with brackets connected to a main upright 93 which extends downwardly from approximately the middle of the steer's body 17. As can be seen in FIG. 3, the pin 91 permits the head 11 of the steer to bob from a higher position H to a lower position L. The bobbing action of the body 17 in relation to the upright 93 is controlled by a shock absorber 95 connected between a first bracket 97 on the upper portion of the steer's body and forward of the main upright 93 and a second bracket 99 mounted on the upright 93 proximate its midpoint. The second bracket 99 is provided with a plurality of holes 101 to permit easy variation of the angular relationship of the main upright 93 to the steer's body 17.

The maximum bob of the head 11 about the pin 91 is limited by a first chain 103 connected in series with a parallel connected coil spring 105 and second chain 107, all of which are connected between one U-clamp 109 welded to the rear side of the main upright 93 at a middle portion thereof and another U-clamp 111 welded to the upper rear portion of the frame 77 of the steer's body 17. The amount of force necessary to be exerted on the steer's head 11 in order to cause the head 11 to bob downwardly about the pin 91 is determined by another coil spring 113 connected between the one U-clamp 109 welded to the main upright 93 and a hook 115. The hook 115 is welded to the nut 117 of a bolt 119 which is mounted for rotation in the frame 77 of the steer body 17. The bolt head 121 is externally accessible from behind the steer, as can best be seen in FIG. 9. Rotation of the bolt head 121 causes the nut 117 to slide transversely in relation to the main upright 93. This changes the tension in the coil spring 113 and controls the amount of force necessary to be exerted upon the head 11 to expand the spring 113 and bob the head 11.

In addition to the bobbing action about the horizontal pin 91, the steer assembly 10 also rotates about a vertical axis 123 extending through a secondary upright member 125. A horizontal member 127 is welded at one end to the secondary upright member 125 and at the other end to a vertical sleeve 129 in which the main upright 93 has its lower end inserted. The main upright 93 is secured in the sleeve 129 by horizontal pins 131 which extend through the sleeve 129 and the main upright 93 and are aligned in the direction of travel T of the steer. The secondary upright member 125 is journalled on the frame of the trailer assembly for rotation about the vertical axis 123. As can be best seen in FIG. 9, the rotation of the support assembly 90 about the axis 123 is prevented by a detent pin 133 which reciprocates vertically in a bearing 135 connected to the sleeve 129 by a bracket 137 welded therebetween. The detent pin 133 is biased toward it lowermost position in the bearing 135 by a tension spring 139 connected between the bearing 135 and the top portion of the detent pin 133. In its lowermost position, the detent pin 133 abuts a stop bracket 141 and prevents the steer assembly 10 and the support assembly 90 from rotating in a counterclockwise direction as viewed from above the steer. As can best be seen in FIG. 7, the upper end of the detent pin 133 is connected by a chain 143 to a lever 145 which pivots about a horizontal pin 147 welded to the upper portion of the main upright 93 of the support assembly 90. The other end of the lever 145 is connected by a cable 148 to the U-clamp 81 on the plate 73 fixed to the inside right rear portion of the lower neck 15. Thus, when the lower neck 15 is turned sufficiently to trigger the lever 145 to remove the detent pin 133 from its abutting position with the stop bracket 141, the body 17 of the steer is released to rotate in the counterclockwise direction about the axis 123 of the secondary upright member 125. Preferably, the chain 143 extending from the detent pin 133 to the lever 145 will have a hook 149 at its upper end which may be rapidly selectively engaged with and removed from one or more holes 151 in the lever 145. This allows variation of the amount of rotation of the lower neck 15 required to release the detent pin 133 from its position against the stop bracket 141. The stop bracket 141 is preferably provided with a roller 153 to facilitate the upward and downward motion of the detent pin 133 in relation to the bracket 141 and the portion of the bracket 141 opposite the roller 153 is inclined to facilitate restoring the support assembly 90 to the detent position.

The rotation of the support assembly 90 about the vertical axis 123 also impacts the relationship of the components of the trailer assembly 200, as can best be understood in reference to FIGS. 10 through 13. Taken with respect to the path of travel T of the steer, the trailer assembly includes forward 201 and rearward 203 transverse frame members connected by side frame members 105 and 107 at the left and right of the trailer assembly 200, respectively. The left hand tire 209 is mounted for rotation on a horizontal axle 211 which in turn pivots about a vertical pin 213 on which the axle bearing 215 is journalled. The axle bearing 215 extends to a shank portion 217 which is connected by a coil spring 219 to the forward trailer frame member 201. Thus the axle 211 is able to rotate radially about the pin 213 in a clockwise direction as viewed from above the steer against the bias of the coil spring 219. Looking at FIGS. 9 and 10, the secondary upright member 125 has a lever 155 mounted on its upper end and a horizontal cam 157 mounted proximate its mid point for rotation with the secondary upright member 125 about the vertical axis 123. The cam surface 159 rides against a roller 221 mounted on the end of a linkage connected to the shank 217 of the trailer axle bearing 215. The linkage consists of a first arm 223 having the roller 221 mounted at one end. Its other end is fixed atop a vertical shaft 225 rigidly connected between the first arm 223 and one end of a lower second arm 227. The arms 223 and 227 rotate in unison with the shaft 225 which rides on a bearing 229 mounted on the trailer frame. The other end of the second arm 227 is pivotally connected by a nut and bolt 231 to a tubular member 233. A lock nut 235 secures the extension of an interior telescoping shaft 237 which is pivotally connected to the shank 217 on the axle bearing 215 by a nut and bolt 239.

Figure 12:
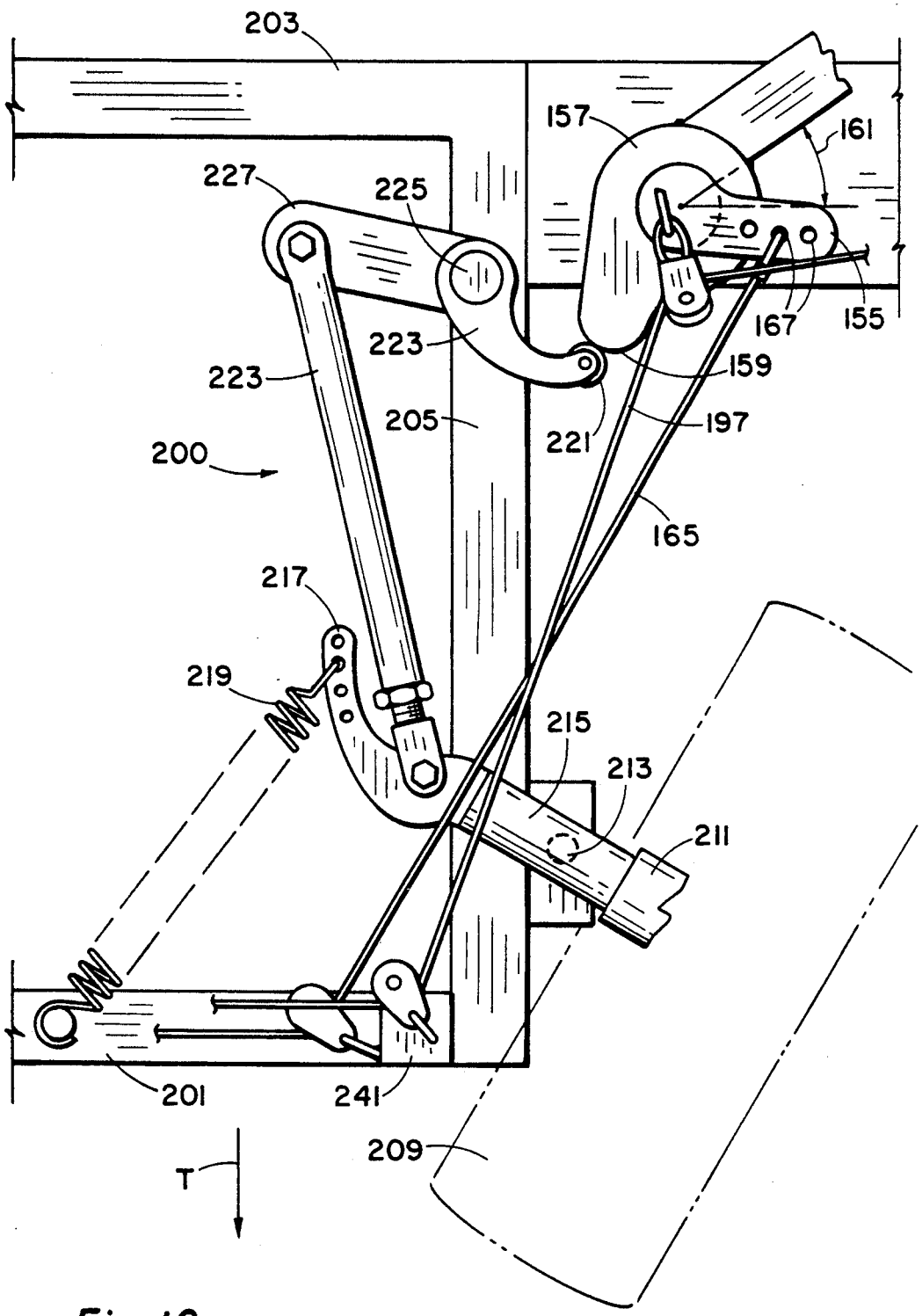
FIG. 12 is a top plan view with parts removed of the trailer wheel assembly of FIG. 10 in a second position.
Figure 13:
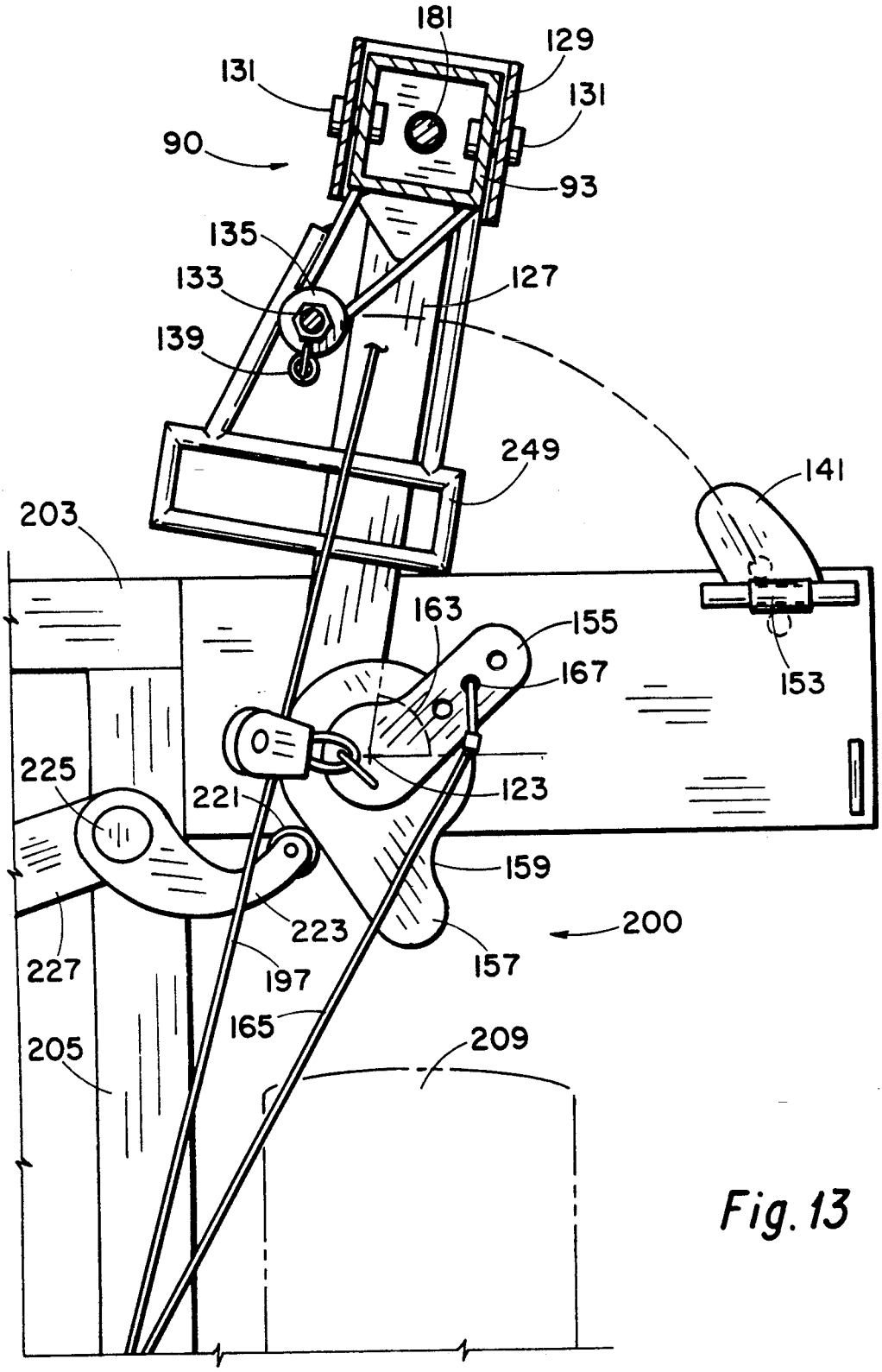
FIG. 13 is a top plan view with parts removed of the trailer wheel assembly of FIG. 10 in a third position.

The linkage extending between the roller 221 and the shank 217 of the axle bearing 215 causes the wheel 209 to be realigned in response to the rotation of the support assembly 90 about the vertical axis 123. The response of the wheel 209 to the rotation of the support assembly 90 is sequentially illustrated in FIGS. 11, 12 and 13. In the initial condition illustrated in FIG. 11, the wheel 209 is aligned in the direction of travel T and the support assembly 90 is locked in position by the detent pin 133 which abuts the stop bracket 141. The linkage is in its normal alignment. When the lower neck 15 has been rotated sufficiently to cause the lever 145 to pull the detent pin 133 out of engagement with the stop bracket 141, the support assembly 90 and the steer body 17 begin to rotate about the vertical axis 123 and the roller 221 begins to move along the cam surface 159, causing the linkage to begin to pull the wheel 209 out of alignment with the path of travel T of the steer. As shown in FIG. 12, the support assembly 90 has rotated about the axis 123 for an angle 161 of approximately 35°. At this point the roller 221 has reached the maximum cam radius and the wheel 209 has achieved its maximum inward turn in relation to the path of travel T of the steer. As the support assembly 90 continues to rotate about the axis 123, the roller 221 continues beyond the maximum cam radius, causing the linkage to return the wheel 209 into alignment with the direction of travel T of the steer, as is shown in FIG. 13. As shown, full realignment of the wheel 209 with the direction of travel T of the steer occurs at an angle 163 of approximately 80°.

As seen in FIGS. 9 through 13, the lever 155 fixed to the top of the secondary upright member 125 rotates with the member 125 about the axis 123. A cable 165 is connected at one of the ends in one of several holes 167 in the lever 155 and runs through a pulley 169 connected to an upright member 241 extending upwardly from the forward transverse frame member 201 of the trailer assembly 200. The other end of the cable 165 is connected to a coil spring 171, as is shown in FIG. 1. The coil spring 171 is in turn connected by a C-clamp 173 to the opposite side of the forward transverse frame member 201. The coil spring 171 determines the amount of force required to permit the steer's body 17 and the support assembly 90 to begin to rotate after the detent pin 133 has been pulled out of abutment with the stop bracket 141. As can be seen in FIG. 1, and for reasons hereinafter explained, the spring 171 is paralleled by a hook 175, chain 177 and sliding pin 179 connected between the cable end of the spring 171 and a trailer frame member 243 supporting the right side frame member 207 of the trailer assembly 200.

In addition to rotation about the vertical axis 123, the main upright 93 also pivots about the pins 131 which extend horizontally through the sleeve 129 and the main upright 93. As can be seen in FIGS. 3 through 9, a rod 181 extends downwardly from a lever 183 at approximately the axial center of the main upright 93 through a hole 185 in a horizontal plate 187 welded in the sleeve 129 below the lower end of the main upright 93. The lever 183 is operated by the cable 51 connected inside the throat 47 of the steer's head 11. Thus, upward rotation of the steer's head 11 about the horizontal hinge 41 causes the pin 181 to be removed from the hole 185 in the plate 187 and releases the main upright 93 to rotate about the pins 131. The steer head rotation necessary for operation of the lever 181 is determined by adjustment of a turnbuckle 189 connected between the lever 181 and the cable 51. The return of the lever 183 to its normal condition is facilitated by the use of a tension spring 191 connected between the lever 181 and the main upright 93.

The force necessary to lay the steer over once the rod 181 has been withdrawn from the hole 185 in the plate 187 is determined by a coil spring 193 connected at one end by a C-clamp 195 to the right side frame member 243 of the trailer assembly 200 and at its other end to a cable 197. The cable 197 extends through a first pulley 245 about the upright member 241 on the left side of the trailer assembly 200 and then through a second pulley 247 which is mounted on the lever 155 above the secondary upright member 125. From here the cable extends to a chain 87 which is connected by a U-clamp 89 to an upper portion of the main upright 93.

Figure 14:
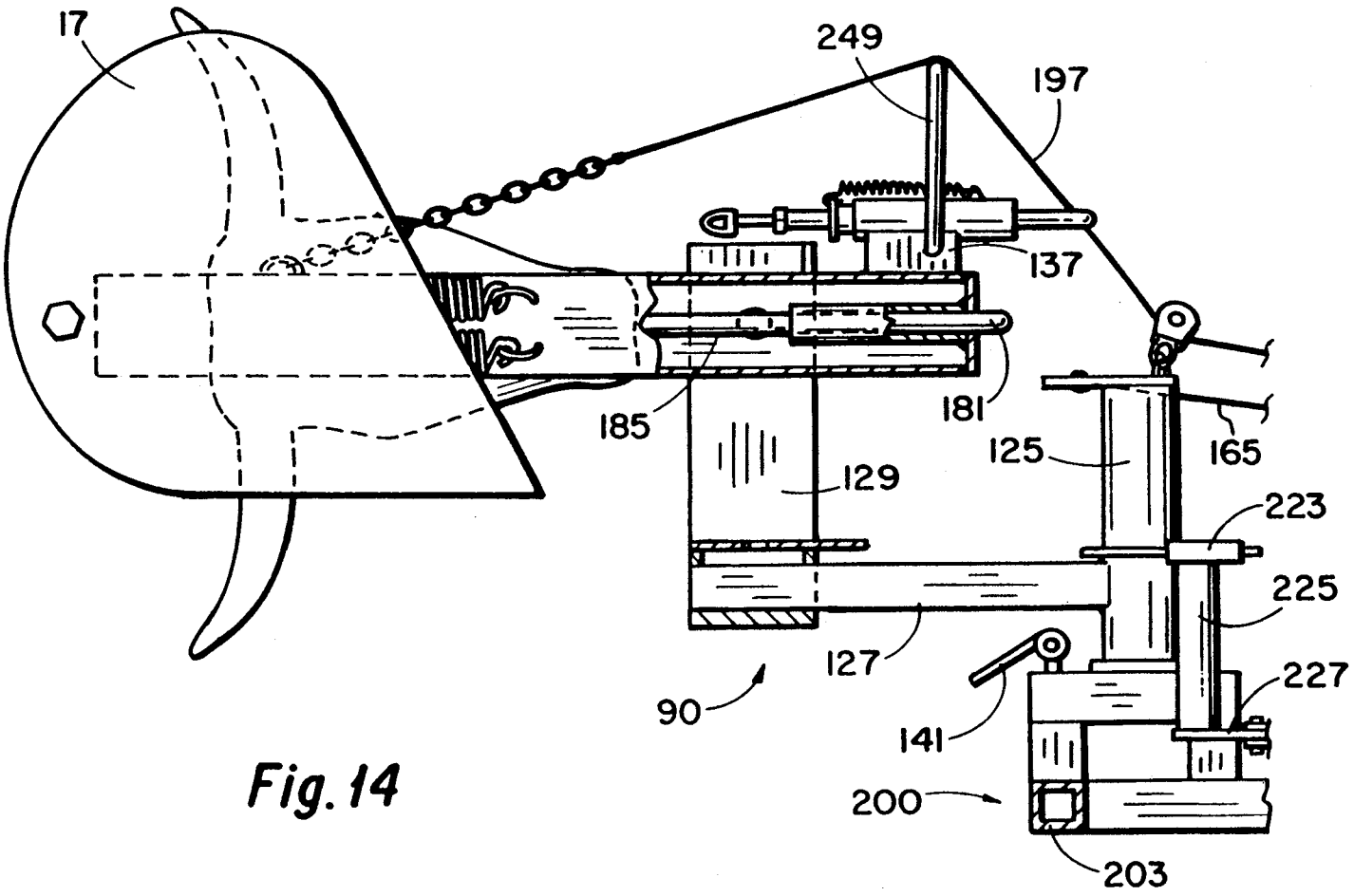
FIG. 14 is a left side elevation with portions removed of the trailer wheel assembly and the body support assembly in a final position of the steer.
Figure 15:
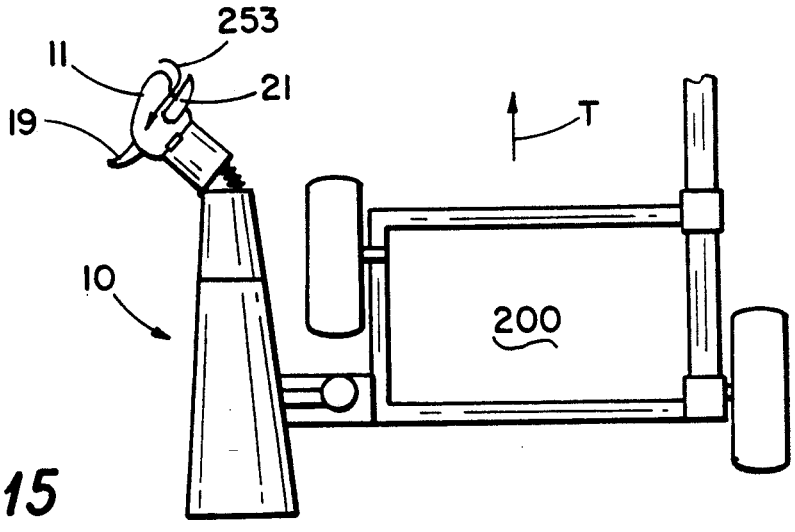
FIG. 15 is a top plan view of the steer wrestling dummy of FIG. 1 in the first stage of the steer wrestling process.

The steer is illustrated in the lay-over condition in FIG. 14. The secondary upright member 125 has rotated approximately 180° so that the horizontal member 127 extends toward the right side of the trailer assembly 200. The vertical sleeve 129 extends upwardly from the horizontal member 127 and the now horizontal main upright 93 is rotated approximately 180° so that it also extends toward the right side of the trailer assembly 200. A guide member 249 welded to the bracket 137 connecting the detent pin bearing 135 to the main upright 93 is rotated to a vertical position when the main upright 93 is horizontal so as to lift the cable 197 clear of the components of the support assembly 90.

Returning to FIGS. 1, 2 and 3, the right hand side member 207 of the trailer assembly 200 extends forward of the forward transverse frame member 201 to form the tongue of the trailer. As shown, the member 207 is tubular and has disposed within it a second tubular member 251 which reciprocally telescopes within the side member 207. The sliding pin 179 connected by the hook 175 of the moving end of the expanding coil spring 171 extends through holes (not shown) in the side frame member 207 and the telescoping member 251 so as to lock the telescoping member 251 in a withdrawn position within the frame member 207. When the cowboy has sufficiently rotated the steer and the support structure 90, as determined by the amount of slack provided in the chain 177, the sliding pin 179 will be withdrawn from the holes and release the telescoping member 251 to slide to an extended condition, thus slowing the motion of the trailer frame 200 even though the vehicle (not shown) towing the trailer assembly 200 has not yet reduced speed.

Turning now to FIGS. 15 through 19, the operation of the steer wrestling dummy can be sequentially observed. Using either a horse or a training rig such as a saddle mounted on and extending upwardly and to the right of a four wheeler to simulate the position of a saddle on a horse (not shown), the cowboy approaches the steer wrestling dummy from its left side as the steer wrestling dummy is drawn by a mechanized vehicle such as a tractor (not shown) connected to the hitch 255 of the trailer assembly 200. The cowboy then releases his left foot from the stirrup and, holding the pommel of his saddle with his left hand, leans out over the steer assembly 10. As the cowboy dismounts his horse and makes physical contact with the steer, the bobbing action of the steer assembly 10 will occur as the downward force of the cowboy on the steer assembly 10 overcomes the tension of the coil spring 113 and the shock absorber 95 connecting the steer assembly 10 to the support assembly 90. At the same time, the cowboy passes his right arm under the right horn 21 of the steer and his left hand grasps the outermost end of the left horn 19 so that he can 'cross' the steer, rotating the steer's head by moving the right horn 21 up and the left horn 19 down, as indicated by the arrow 253. This rotation is accomplished against the force established by the coil spring 33 in the upper neck 13 of the steer as is seen in FIGS. 4 and 5. With the steer's horns 19 and 21 still grasped in the left hand and under the right arm of the cowboy, and with the cowboy's heels digging into the ground, the cowboy begins to turn the steer's head 11 around his body by rotating the upper neck 13 about the hinge 63 connecting the upper neck 13 and the lower neck 15 for an angle 257 of approximately 45°.

Figure 16:
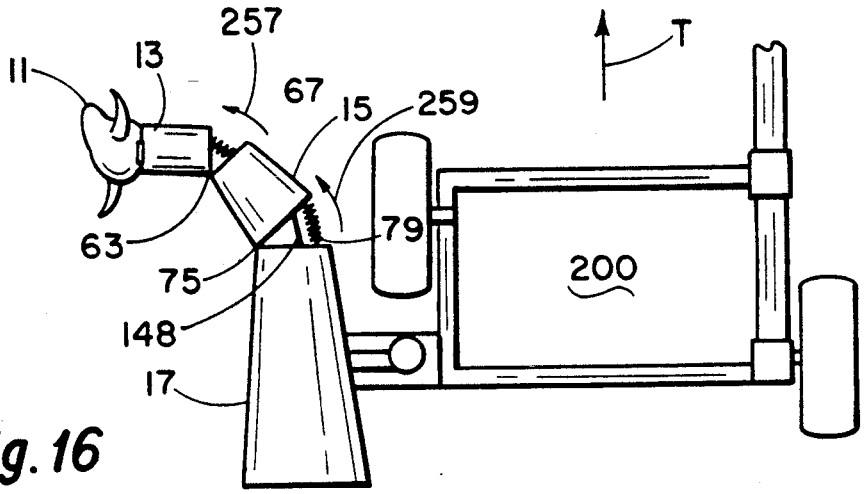
FIG. 16 is a top plan view of the steer wrestling dummy of FIG. 1 in a second steer wrestling position.

Moving to FIG. 16, the turning action is continued by the rotation of the lower neck 15 about the hinge 75 connecting the lower neck 15 and the body 17, again for a angle 259 of approximately 45°. As shown, the hinges will operate to allow the head 11 to be turned to a position approximately transverse to the original path of travel T of the steer. The force the cowboy must exert to accomplish this turning motion is determined by the coil spring 67 connecting the upper neck 13 to the lower neck 15 and the coil spring 79 connecting the lower neck 15 to the body 17. As the head 11 is being turned, the cable 148 connecting the lever 145 which operates the detent pin 133 is also being pulled.

Figure 17:
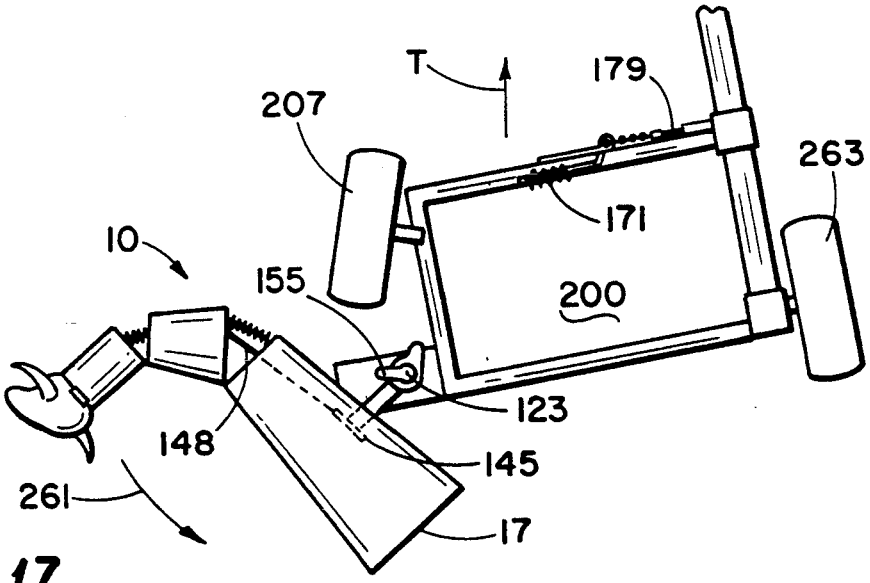
FIG. 17 is a top plan view of the steer wrestling dummy of FIG. 1 in a third steer wrestling position.

Looking now at FIG. 17, when the cable 148 has been pulled sufficiently so that the lever 145 causes the detent pin 143 to be pulled clear of the stop bracket 137, the body 17 of the steer can rotate about the axis 123 extending through the secondary upright member 125. At this point, the cowboy's hip is being thrust into the steer's side to shift the rear portion of the steer to the right. This shifting action of the steer is simulated as the linkage connecting the inside tire 207 with the secondary upright member 125 causes the tire 207 to realign inwardly during the time that the roller 221 of the linkage passes from its normal condition to its maximum radial distance from the axis 123. This thrusts the trailer assembly 200 to the right, shifting the position of the steer. The force necessary to cause the steer's body to rotate in a direction 261 about the axis 123 is determined by the coil spring 171 connected between the lever 155 atop the secondary upright member 125 and the right side of the trailer frame 200. In addition, when the coil spring 171 has been sufficiently expanded to withdraw the pin 179 which connects the telescoping tongue 251 of the trailer assembly 200 to its side member 207, the tongue 251 will be extended from the member 207, thus slowing the movement of the trailer assembly 200 in relation to the towing vehicle (not shown).

Turning to FIG. 18, when the steer's body 17 has been rotated approximately 110° to 130° in relation to its original path of travel T and the left trailer tire 207 has returned to parallel relationship with the right tire 263, the cowboy slides his left hand off the left horn 19 of the steer and passes his left forearm under the nose of the steer. The cowboy then rotates the steer's head upwardly about the hinge 41 connecting the steer's head 11 to its upper neck 13, as shown in FIG. 3. The force necessary for this upward rotation of the steer's head 11 is determined by the coil spring 57 connecting the steer's head 11 to the body 17. This lifting of the steer's head in the direction 265 shown causes the lever 183 to operate to withdraw the rod 181 from the plate 187 in the vertical sleeve 129.

As shown in FIG. 19, once the rod 181 has been removed from the plate 187, the main upright 93 is free to rotate about the pins 131 in the direction 267 shown to lay the steer over to the ground in a position approximately 180° from the original path of travel T. The force to lay the steer over in this direction 267 is determined by the coil spring 193 connected between the main upright 93 and the right side of the trailer assembly 200.

When the training sequence is completed, the cowboy can reset the device. He raises the steer assembly 10 until the rod 181 reengages in the plate 187 and then rotates the steer back to the initial travel direction T. As this happens, the detent pin 133 will be forced upwardly on the inclined plane of the stop bracket 141 until the pin 133 passes over the roller 153 and is pulled downwardly by the bias of the reset spring 139 to lock the support assembly 90 in this position. The trailer assembly 200 is then moved forward toward the towing vehicle (not shown), thus withdrawing the telescoping tongue 251 into the trailer side member 207, and the pin 179 is inserted into the telescoping assembly to lock the trailer assembly 200 in this condition.

Once the telescoping tongue 251 has been locked in its withdrawn condition in the side member 207 of the trailer assembly 200, the cowboy is ready to repeat the training exercise. If, however, it is desirable to change the strength characteristics of the steer to suit the size, strength and ability of the training cowboy, the force necessary to overcome any or all of the coil spring components establishing those forces is readily adjusted by changing the link of chain connected to those coils, by adjusting turnbuckles or lever-like connections or by adjustment of the bolt 121 in the back portion of the steer.

Figure 20:
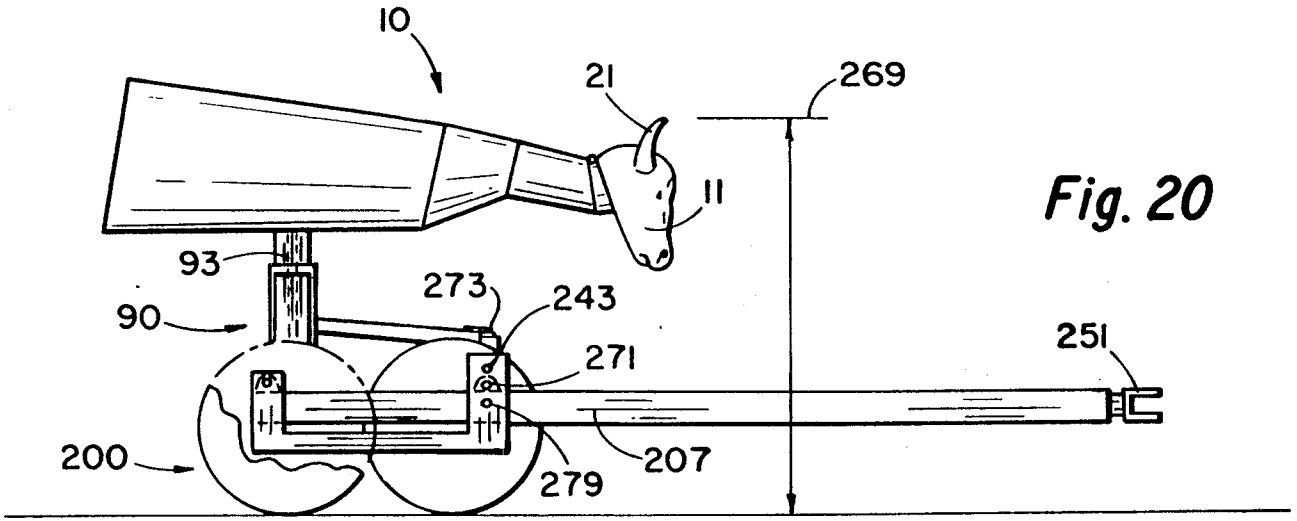
FIG. 20 is a side elevational view illustrating the steer wrestling dummy of FIG. 1 in a first horn level condition.
Figure 21:
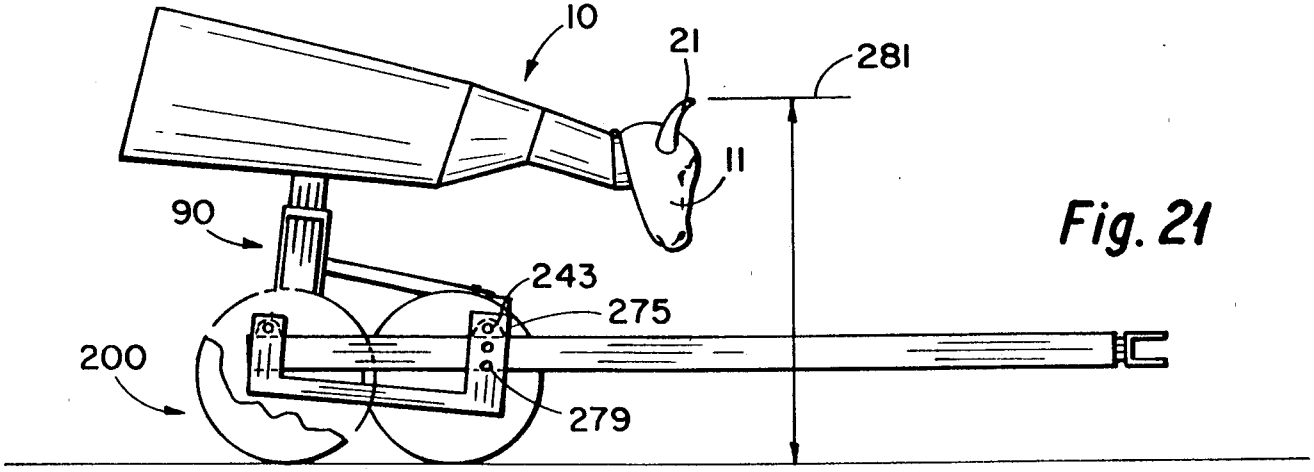
FIG. 21 is a side elevation view illustrating the steer wrestling dummy of FIG. 1 in a second horn level condition.

As can best be seen in FIGS. 20 and 21, the trailer assembly 200 is also designed to permit selection of the initial level of the steer's head 11. In FIG. 20, with the tip of the right horn 21 at a mid level 269 above ground, a pin 271 inserted through the frame member 243 and a reciprocal member 273 vertically slidable within the frame member 243 establishes the height of the reciprocal member 273. The top of the member 273 is in turn connected to the support assembly 90 so that the position of the pin 271 determines the level of the steer's head 11. As shown, the frame 243 is provided with one or more holes 275 above the intermediate hole 277 and one or more holes 279 below an intermediate hole 277. Thus, as seen in FIG. 21, if the pin 271 is shifted to an upper hole 275 in the member 243, the steer's head will be brought to a lower position 281. Conversely, if the pin is extended through the lower hole 279 in the member 243 the steer's head will be raised to a level above the mid level 269.

It should be noted that the linkages, chains, cables, turnbuckles, coil springs, shock absorbers and the like set forth in this description can be replaced or substituted by alternative mechanisms without deviating from the teachings of this description.

Thus, it is apparent that there has been provided, in accordance with the invention, a steer wrestling dummy that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A steer wrestling dummy towable by a motorized vehicle comprising:

a body;

a neck hingedly connected to said body for lateral turning of said neck relative to said body, said neck having an upper neck hingedly connected to a lower neck portion for lateral turning of said upper neck portion relative to said lower neck portion in the same direction as said neck turns relative to said body;

a head hingedly connected to said neck for upward rotation of said head relative to said neck;

means having an upper portion connected to said body for supporting said body in an upright position; and frame means mounted on at least two spaced apart tires and connected to a lower portion of said supporting means for transporting said supporting means overland with said body positioned laterally of and above said frame and with said body aligned for forward movement therewith.

2. A steer wrestling dummy according to claim 1 further comprising means connected between said upper and lower neck portions for biasing said upper neck portion against said lateral turning relative to said lower neck.

3. A steer wrestling dummy according to claim 2 further comprising means connected between said lower neck portion and said body for biasing said lower neck portion against said lateral turning relative to said body.

4. A steer wrestling dummy according to claim 3 further comprising means connected to said lower neck portion biasing means for varying a biasing force thereof.

5. A steer wrestling dummy according to claim 4, said upper neck portion having two segments connected end-to-end for rotation about a longitudinal axis and means connected to said first and second segments for resiliently biasing said first segment against said axial rotation.

6. A steer wrestling dummy according to claim 5 further comprising a flexible boot snugly encasing said upper neck portion.

7. A steer wrestling dummy according to claim 1 further comprising means connected between said head and said body for biasing said head against said upward rotation relative to said upper neck portion.

8. A steer wrestling dummy according to claim 7 further comprising means connected to said upward rotation biasing means for varying a biasing force thereof.

9. A steer wrestling dummy according to claim 1, said supporting means being pivotally connected to said body for rotation about a horizontal axis transverse to said forward alignment for bobbing said head thereabout.

10. A steer wrestling dummy according to claim 9 further comprising means connected between said body and said supporting means for biasing said body against downward rotation of said head.

11. A steer wrestling dummy according to claim 10 further comprising means connected to said body biasing means for varying a biasing force thereof.

12. A steer wrestling dummy according to claim 1, said supporting means having a main upright connected to said body, a secondary upright journalled on said frame means for rotation about a vertical axis and an arm connected therebetween.

13. A steer wrestling dummy according to claim 12 further comprising means connected between said supporting means and said frame means for biasing said supporting means against rotation about said vertical axis in a direction outwardly and rearwardly of said frame means.

14. A steer wrestling dummy according to claim 13 further comprising means connected to said biasing means for varying a biasing force thereof.

15. A steer wrestling dummy according to claim 13 further comprising means eccentric of said vertical axis for reciprocally engaging and disengaging said supporting means to and from said frame means to lock said supporting means against and release said supporting means for, respectively, rotation about said axis.

16. A steer wrestling dummy according to claim 15 further comprising means connected between said lower neck portion and said eccentric reciprocal means for operating said reciprocal means to release said support means to rotate about said vertical axis when said lower neck portion rotates to a preselected angle relative to said body.

17. A steer wrestling dummy according to claim 16 further comprising means connected between said reciprocal means and said support means for biasing said reciprocal means toward locking engagement with said frame means.

18. A steer wrestling dummy according to claim 13, one of said tires closest to said support means being mounted on axle means journalled on said frame means for adjusting the steering alignment of said one of said tires relative to the other of said tires.

19. A steer wrestling dummy according to claim 18 further comprising linking means connected between said secondary upright and said axle means for adjusting said alignment of said one tire in response to rotation of said secondary upright member.

20. A steer wrestling dummy according to claim 19, said linking means having a cam means for initiating and terminating adjustment of said alignment at first and second selected angles of rotation of said secondary upright.

21. A steer wrestling dummy according to claim 20, said linking means having a means for varying said selected angles.

22. A steer wrestling dummy according to claim 13 further comprising telescoping means connected to and extending forwardly of said frame means and adapted at a forward end thereof for connecting said frame means to said motorized vehicle and reciprocal means for locking and releasing said telescoping means against and to extension thereof, respectively.

23. A steer wrestling dummy according to claim 22 further comprising means connecting said reciprocal means to said secondary upright for releasing said telescoping means when said secondary upright has rotated a selected angle.

24. A steer wrestling dummy according to claim 13, said supporting means having an upper segment pivotally connected to a lower segment for articulation laterally relative to said body and toward said vertical axis to lay said body on one side thereof.

25. A steer wrestling dummy according to claim 24 further comprising means connected between said upper segment and said frame means for biasing said upper segment against said lateral articulation.

26. A steer wrestling dummy according to claim 25 further comprising means connected to said articulation biasing means for varying a biasing force thereof.

27. A steer wrestling dummy according to claim 25 further comprising means reciprocally connected between said upper and lower segments for locking and releasing said upper segment against and to said articulation.

28. A steer wrestling dummy according to claim 27 further comprising means connected between said reciprocal means and said head for releasing said upper segment for articulation when said head is upwardly rotated relative to said upper neck portion to a selected angle.

* * * * *